United States Patent [19]

Tye

[11] 4,083,156

[45] Apr. 11, 1978

[54] APPARATUS FOR BRACING A TILT-UP WALL PANEL

[75] Inventor: Dennis W. Tye, Hayward, Calif.

[73] Assignee: Superior Concrete Accessories, Inc., San Diego, Calif.

[21] Appl. No.: 787,597

[22] Filed: Apr. 14, 1977

[51] Int. Cl.[2] ..... E04G 25/04; E04H 12/20

[52] U.S. Cl. ..... 52/127; 52/125; 52/149; 52/632; 52/749; 248/354 P; 248/354 S; 248/431; 269/321 S; 403/64; 403/68; 403/70; 403/379

[58] Field of Search ..... 52/122, 125, 127, 149, 52/632, 749; 248/155, 163, 164, 431, 354 R, 354 C, 354 L, 354 P, 354 S; 403/58, 62, 64, 66, 68, 70, 119, 379

[56] References Cited

U.S. PATENT DOCUMENTS

| | | | |
|---|---|---|---|
| 1,159,472 | 11/1915 | Christofferson | 403/64 X |
| 1,349,980 | 8/1920 | Richards | 52/64 |
| 1,811,217 | 6/1931 | Spaugh | 52/122 X |
| 2,514,840 | 7/1950 | Charles | 403/64 |
| 2,584,713 | 2/1952 | Kanaval | 403/68 X |
| 2,939,360 | 6/1960 | Carten | 248/431 X |
| 3,204,910 | 9/1965 | Gacher | 248/354 S |
| 3,229,950 | 1/1966 | MacRobbie | 248/354 S |
| 3,782,052 | 1/1974 | Vetovitz | 52/122 X |
| 3,798,856 | 3/1974 | Gloskowski | 52/127 |
| 3,998,294 | 12/1976 | Moeller | 248/354 R |

FOREIGN PATENT DOCUMENTS

| | | | |
|---|---|---|---|
| 1,024,763 | 1/1953 | France | 248/354 S |
| 1,561,432 | 2/1969 | France | 248/354 P |
| 1,043,907 | 9/1966 | United Kingdom | 248/354 S |

*Primary Examiner*—Alfred C. Perham
*Attorney, Agent, or Firm*—Norman H. Gerlach

[57] ABSTRACT

A tilt-up wall panel in raised position is braced with panel brace assemblies, and the panel brace assemblies are braced with a pair of knee brace assemblies for each panel brace assembly, to form a tripod-like structure which eliminates the need for the conventional lateral bracing of the panel brace assemblies. The knee brace assemblies are connected to the wall panel, and for that purpose, two knee brace assemblies extending laterally between a pair of spaced apart panel brace assemblies include a connector common to both and which is connected to the wall panel. A preferred connector includes a base plate adapted to be connected to the wall panel, and a pair of swivel means mounted on one side of the base plate and each forming part of one of the latter two knee brace assemblies.

15 Claims, 11 Drawing Figures

APPARATUS FOR BRACING A TILT-UP WALL PANEL

BACKGROUND OF THE INVENTION

This invention relates to apparatus for bracing a tilt-up wall panel. More particularly, the invention relates to bracing apparatus which includes panel brace assemblies and knee brace assemblies.

Tilt-up construction is a job-site form of precast concrete construction. It involves prefabricating concrete wall panels or slabs flat on either the building floor slab or a temporary casting slab, then lifting or "tilting" them up with a mobile crane and carrying them to their final locations, where they are installed as vertical wall panels and become integral parts of the completed structure. In the erection of a tilt-up wall panel, the panel is connected temporarily to lifting to hoisting equipment, utilizing accessory lifting apparatus connected to the panel, and the panel is raised from the horizontal position in which it is cast to a vertical position. The raised wall panel is braced to support it while construction of the wall and other structure is completed. U.S. Pat. Nos. 2,684,824 and 3,798,856 illustrate two types of bracing apparatus employed in the past.

The lifting apparatus connected to a wall panel includes an anchor insert which is embedded permanently in the panel, and a pickup unit which is releasably connected to the insert and thereby to the panel, by fastening means engaging the insert. The pickup unit also is releasably connected to the lifting equipment. In practice, a plurality of inserts is embedded in a concrete panel by pouring wet concrete therearound and setting the concrete, and a pickup unit is connected to each embedded insert and also to the lifting equipment.

At the same time that the inserts of the lifting apparatus are embedded in the concrete forming the panel, similar inserts are embedded for connection to panel brace assemblies or braces. The brace assemblies generally are constructed of lumber or pipe, together with suitable fittings. The upper ends of the panel brace assemblies are connected to the bracing inserts after the concrete has set, and the panel is raised to a vertical position with the panel brace assemblies connected thereto. The lower ends of the panel brace assemblies then are connected to similar bracing inserts which previously were embedded in the adjacent floor slab, to thereby brace the wall panel. Additional panels are erected with their side edges adjacent to each other and are braced, in the same manner, for forming a wall. After bracing, the pickup units are disconnected from the panels. The bracing apparatus then serves to hold the panels plumb and resist wind loads while the walls are completed and a covering structure is constructed. Thereafter, the bracing apparatus is disconnected from the wall panels.

When certain wall panel dimensions and the corresponding dimensions of the panel brace assemblies are exceeded, additional bracing, termed "knee bracing", is required for bracing the panel brace assemblies. The knee bracing prevents sagging or bending of the panel brace assemblies, which would cause the panel to move out of vertical alignment and lower the resistance to wind loads. Such sagging or bending otherwise occurs due to the weight of the panel brace assemblies and wind loads. In a conventional method of bracing, a knee brace assembly or brace, similarly constructed of lumber or pipe, is connected to a panel brace assembly at a central location, and the knee brace assembly is extended downwardly therefrom and in the same vertical plane, to the wall panel. The lower end of the knee brace assembly is connected to the wall panel. In addition, lateral bracing of lumber or pipe, generally parallel to the wall panel, is extended horizontally between successive panel brace assemblies and is connected thereto at points adjacent to the knee brace assembly connections, to provide lateral brace stability.

The use of lateral bracing results in delays in construction and additional labor requirements. Thus, for example, it may be necessary to position mobile equipment such as a fork lift truck near the face of the wall panel, in order to erect components of a roof system. It then is necessary to remove the lateral bracing, to permit access of the truck, and the lateral bracing must be replaced when the truck has completed its work. Also, depending upon the design of the building, it may be necessary to erect a form for a concrete column that is cast in place after the wall panels are erected. An example is the construction of a pilaster between spaced apart side edges of adjacent panels. The column forms generally are made on the ground for the full height of the column, and then are simply lifted or pushed into position. In such cases, the lateral bracing again must be removed to allow positioning of the concrete formwork, and then replaced.

SUMMARY OF THE INVENTION

An important object of the invention is to provide apparatus for bracing a tilt-up wall panel which eliminates the need for lateral bracing. An accompanying object is to provide bracing apparatus which allows mobile equipment to be moved up close to a braced panel and allows forms for columns to be placed, as desired, without alteration or adjustment of the bracing.

Another important object is to provide bracing apparatus which saves construction time, reduces labor cost, and reduces the cost of materials.

An additional object is to provide bracing apparatus of the foregoing character which utilizes conventional equipment, readily available and familiar to personnel.

A specific object is to provide bracing apparatus which embodies a panel brace assembly adapted to extend angularly upwardly from a floor slab to a tilt-up wall panel with its lower end connected to the slab and its upper end connected to the panel to brace the panel, and a pair of knee brace assemblies each adapted to extend angularly upwardly from the panel to the panel brace assembly, the knee brace assemblies having their upper ends connected to the panel brace assembly and their lower ends connected to the panel at spaced apart points of opposite sides of the vertical plane containing the panel brace assembly to brace the assembly.

Another specific object is to provide a connector by which two adjacent knee brace assemblies connected to respective panel brace assemblies may be connected to a wall panel.

These and other objects, advantages and functions of the invention will become apparent from the following description taken in conjunction with the accompanying drawings illustrating preferred embodiments of the invention.

BRIEF DESCRIPTION OF THE DRAWINGS

In the drawings, like elements are identified by like reference symbols in each of the views, and.

DESCRIPTION OF THE PREFERRED EMBODIMENTS

Figure 1:
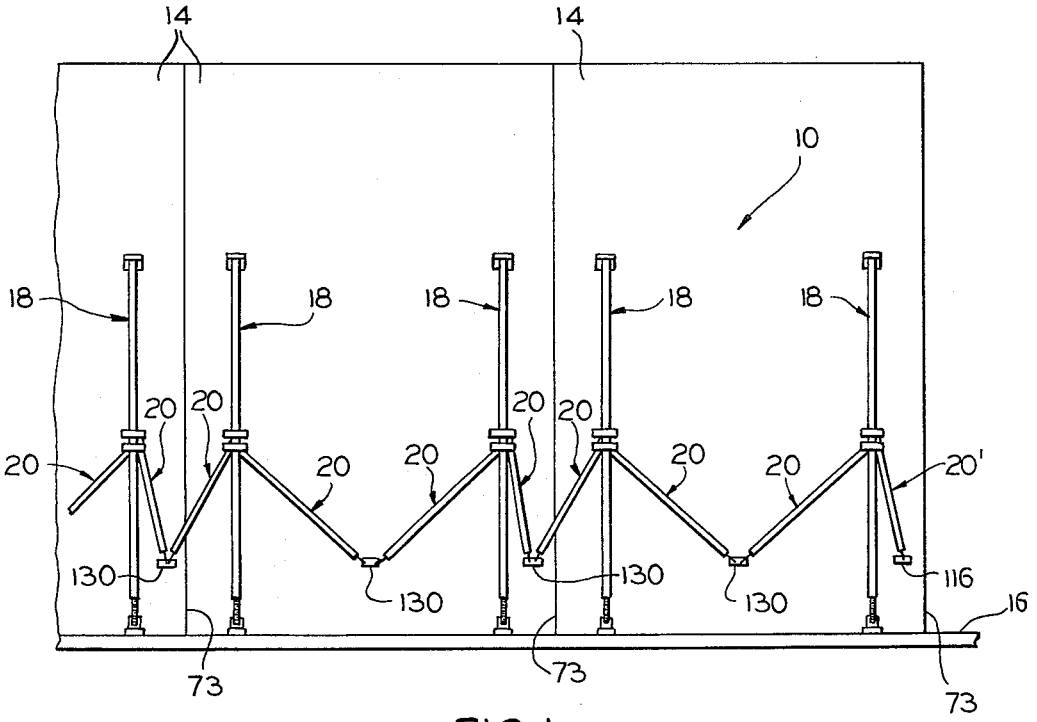
FIG. 1 is a schematic front elevational view of bracing apparatus according to the invention, assembled with tilt-up wall panels in raised position and a floor slab adjacent thereto.
Figure 2:
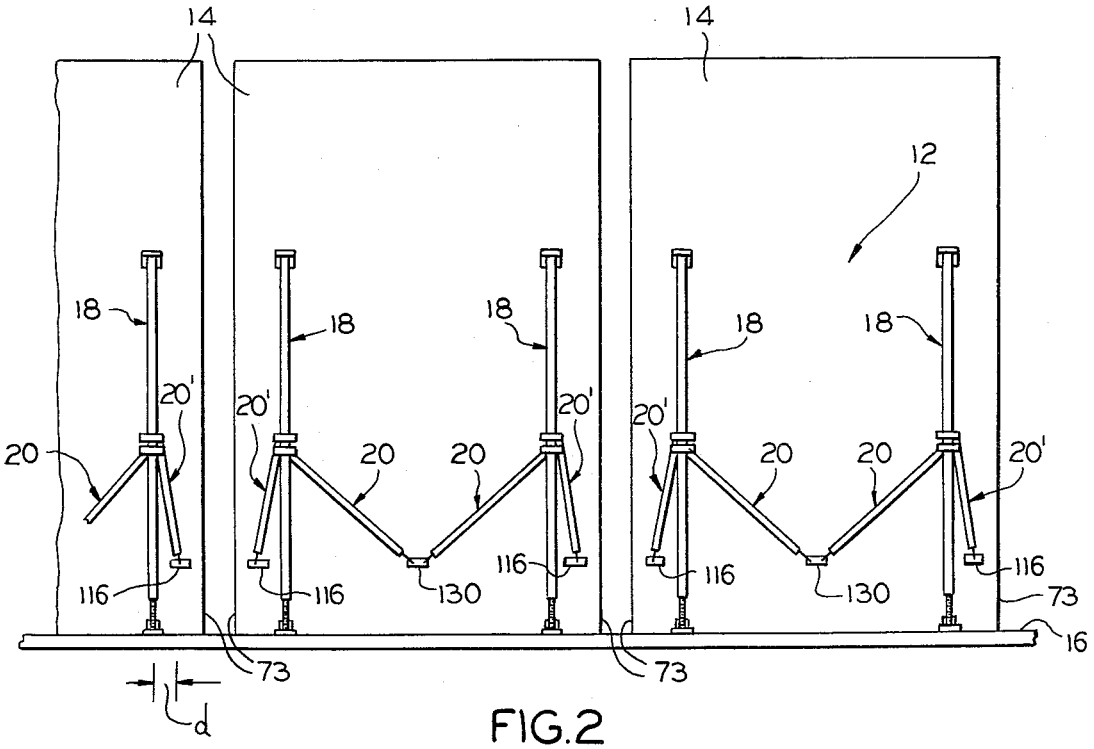
FIG. 2 is a view similar to FIG. 1, illustrating another embodiment of bracing apparatus employed with a different arrangement of the wall panels.

Referring to the drawings, FIGS. 1 and 2 schematically illustrate bracing apparatus 10 and 12, respectively, in combination with tilt-up wall panels 14 in raised or vertical positions adjacent to floor slabs 16. Reference to a floor slab herein is intended to include a temporary casting slab. The bracing apparatus 10 and 12 include panel brace assemblies 18 and knee brace assemblies 20 and 20′, in different combinations in the two views.

Figure 3:
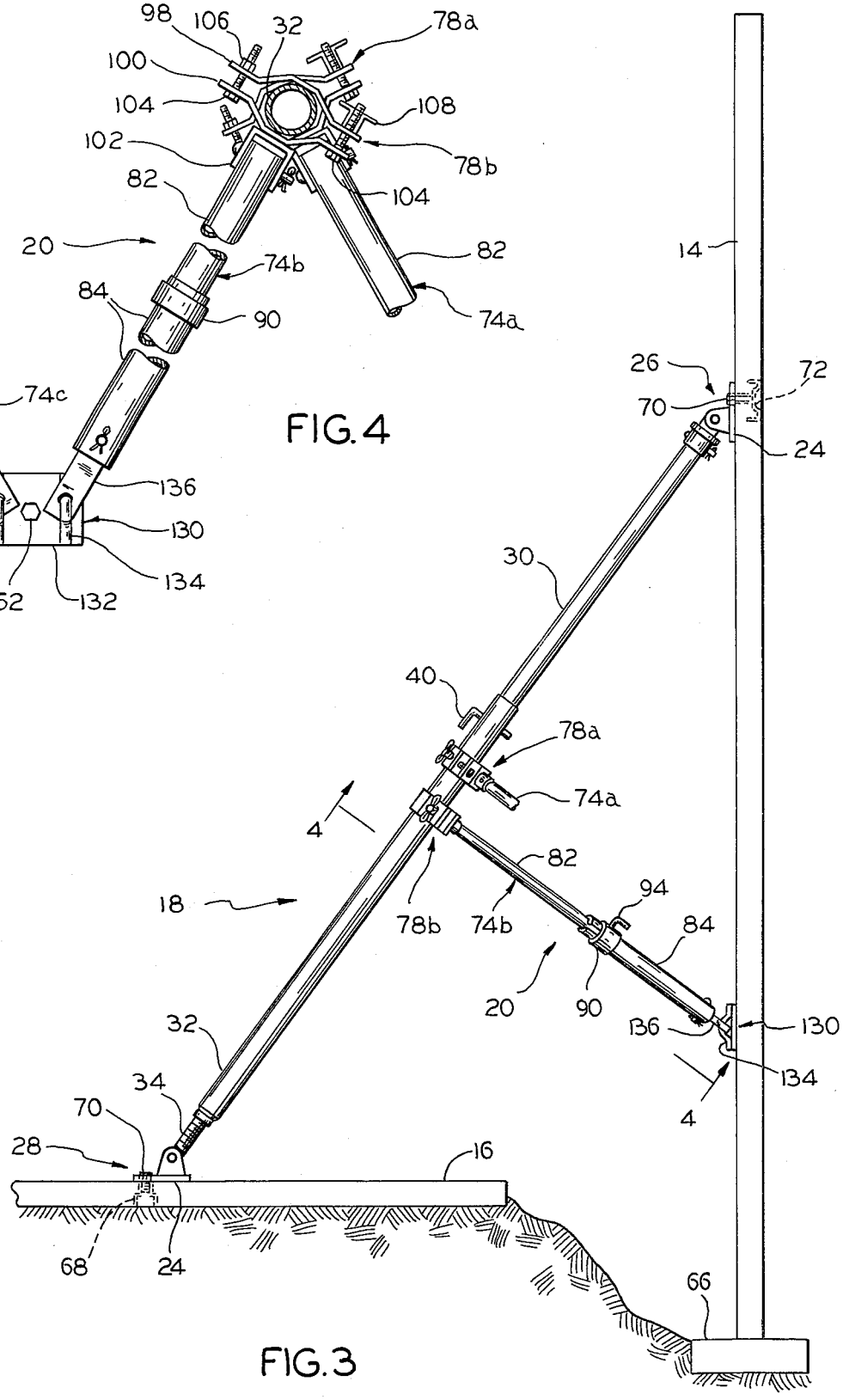
FIG. 3 is an enlarged side elevational view of bracing apparatus components which are common to the apparatus illustrated in FIGS. 1 and 2.
Figure 6:
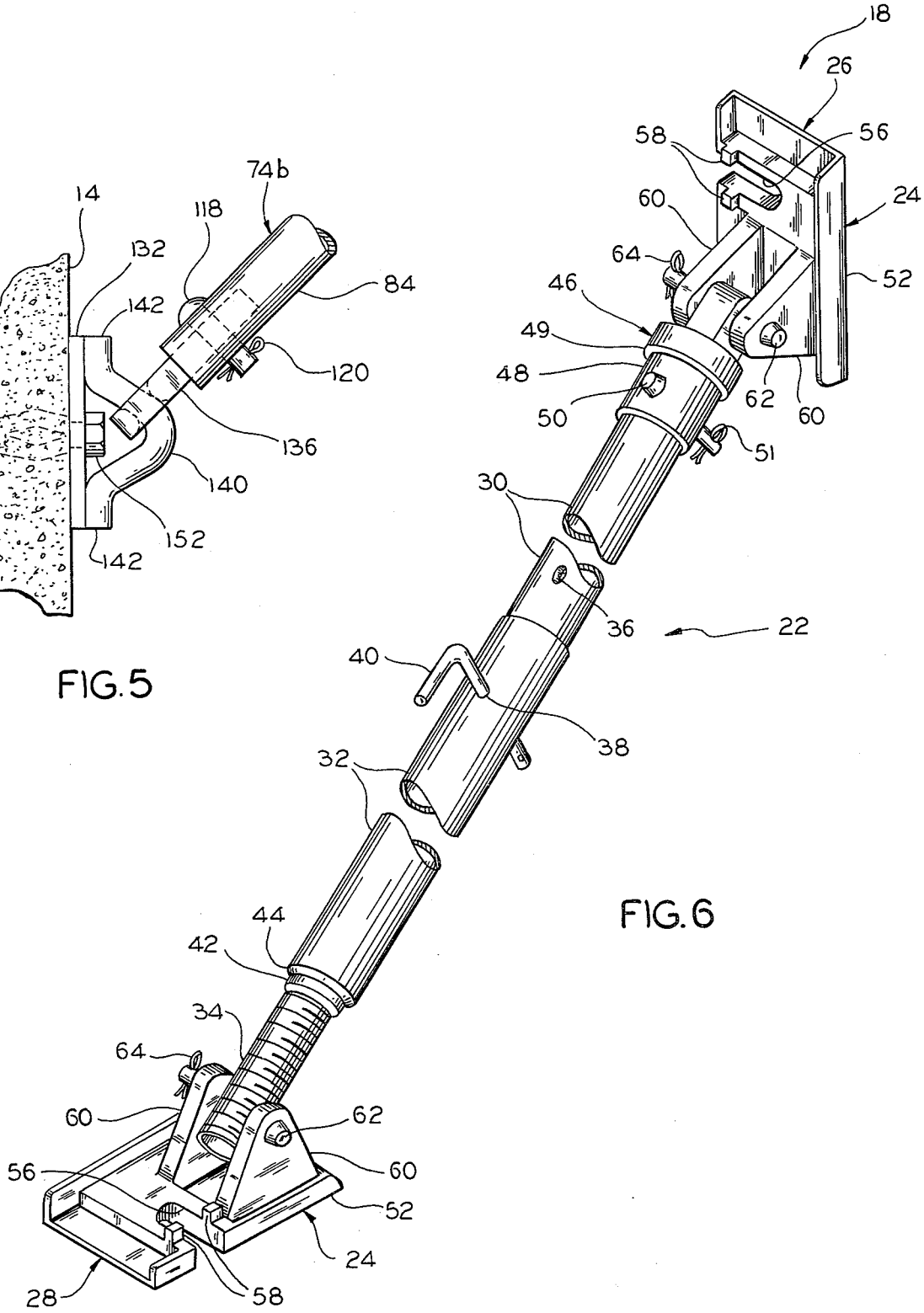
FIG. 6 is a similarly enlarged broken perspective view of a panel brace assembly in the bracing apparatus.

Referring to FIGS. 3 and 6, the panel brace assembly 18 is a conventional structure of elongated pipe means 22 connected to mounting brackets 24 at opposite upper and lower ends 26 and 28, respectively, of the assembly. The pipe means 22 includes telescoping upper and lower cylindrical tubular metal pipe sections 30 and 32, and an externally threaded cylindrical tubular metal extension screw 34 telescopically received in the lower end of the lower pipe section 32.

The upper pipe section 30 is provided with a series of longitudinally spaced apart length adjustment holes 36, and the lower pipe section 32 is provided with a single adjustment hole 38 adjacent to its upper end. The latter adjustment hole 38 is adapted to register with a selected adjustment hole 36 in the upper pipe section 30, for adjusting the length of the pipe means 22, and an L-shaped adjustment pin 40 is inserted in the registering holes 36 and 38 in a selected adjustment.

The extension screw 34 is received in threaded engagement with an internally threaded adjusting nut 42, in turn inserted in the lower end of the lower pipe section 32 and fixedly secured thereto, as by a weld 44. The pipe sections 30 and 32 are moved longitudinally relative to each other for coarse length adjustment of the pipe means 22, and the extension screw 34 and the lower pipe section 32 are moved longitudinally relative to each other for fine adjustment thereof.

A conventional rotation fitting 46 is mounted on the upper end of the upper pipe section 30. The rotation fitting 46 includes a tubular sleeve 48 mounted on the pipe section 30, and a circular cap 49 mounted on the sleeve 48 to rotate about the longitudinal axis thereof. The sleeve 48 is fixed to the pipe section 30 by means of a headed pin fastener 50 inserted through registering holes, not shown, therein, and a cotter pin 51 inserted through a hole in the tail portion of the fastener. A connecting lug 52 is integral with the cap 49 and projects longitudinally outwardly therefrom.

Each mounting bracket 24 is a metal casting which includes a rectangular base portion 54 having a transverse slot 56 extending from one lateral edge thereof, a pair of integral bolt stops 58 on opposite sides of the slot 56 and upstanding on the base portion 54, and a pair of spaced parallel wing portions 60 integral with the base portion 54 and upstanding thereon with their sides extending longitudinally thereof. The lower mounting bracket 24 is pivotally connected to the extension screw 34 by means of a headed pin fastener 62 extending through registering holes, not shown, in the wing portions 60 and the extension screw 34, and a cotter pin 64 inserted through a hole in the tail portion of the fastener. The upper mounting bracket 24 is pivotally connected to the rotation fitting 46 by means of another pin fastener 62 inserted through registering holes, not shown, in the wing portions 60 and the connecting lug 52, and a cotter pin 64 inserted through the tail portion of the fastener.

Referring to FIG. 3, it is conventional practice to erect tilt-up wall panels 14 on bearing pads 66 set below grade at opposite ends of each panel, or on a continuous footing, by the procedure described above. The previously poured floor slab 16 is adjacent to and spaced from the panels 14. In the process of pouring the floor slab 16, anchor inserts 68 (such as Superior Concrete Accessories, Inc. Type F) are embedded in the slab, and serve to receive connecting bolts 70 in threaded engagement therewith. Similarly, anchor inserts 72 (such as Superior Concrete Accessories, Inc. Type W) are embedded in the wall panels 14, and each insert receives a connecting bolt 70 in threaded engagement therewith.

The upper ends 26 of the panel brace assemblies 18 are connected to the panels 14 before the panels are raised, by inserting a connecting bolt 70 through the slot 56 in each of the upper mounting brackets 24 and into threaded engagement with an anchor insert 72. When the bolt is tight, the stops 58 engage the bolt head and prevent removal of the bracket 24 from the bolt. After the wall panels 14 are raised into vertical positions, as illustrated in FIG. 3, the lower end 28 of each panel brace assembly 18 similarly is connected to the floor slab 16, by inserting a connecting bolt 70 through the slot 56 in the lower mounting bracket 24 and into threaded engagement with an anchor insert 68. The pipe sections 30 and 32 and the extension screw 34 of each panel brace assembly 18 are adjusted longitudinally relative to each other, so that the panels 14 are plumb.

It is recommended that the right triangle formed by the panel brace assembly 18, the vertical raised wall panel 14, and the horizontal floor slab 16 (projected to intersect the wall panel 14) have sides in proportions such that the base of the triangle represents three units of length, the upright side corresponding to the altitude represents four units of length, and the hypotenuse represents five units of length. It then is recommended that the height or altitude of the triangle also represent two-thirds of the height of the panel 14 above the elevation of the upper surface of the floor slab 16. The panel brace assemblies 18 are spaced inwardly from the side edges of a panel 14, and, depending upon the width of the panel, two or more panel brace assemblies 18 are spaced across the width of the panel, preferably in parallel relation and extending in vertical planes substantially perpendicular to the panel 14. At times, for example, at the corners of a building structure, it may be necessary to incline the panel brace assemblies 18 somewhat, across the face of the panel to which they extend. As an example of the spacing, two panel brace assemblies 18 may be employed for a 20-foot wide panel 14, each assembly being spaced inwardly from the adjacent side edge 73 of the panel for a distance of about 3–4 feet.

The panel brace assemblies 18 erected in the foregoing manner may be employed alone, without additional bracing, up to certain limits, which depend upon the factors involved. Thus, for example, certain commercial pipe style panel brace assemblies may be employed without additional bracing until they are extended up to about 16 feet, beyond which additional bracing is required. Where additional bracing has been required in the past, a knee brace assembly 20', having the components illustrated in FIGS. 7 and 8 and described hereinafter, has been employed. The knee brace assembly 20' was connected to each panel brace assembly 18, at about the midpoint thereof, and inclined downwardly towards the wall panel 14, to which it was secured. The knee brace assembly 20' laid in the vertical plane of the panel brace assembly 18, to provide coplanar support thereunder. Also, as described above, lateral bracing was strung between successive panel brace assemblies 18, at about the midpoints thereof. Consequently, as can be visualized by reference to FIGS. 1–3, access to the wall panels 14 by mobile equipment was blocked by the lateral bracing, which therefore had to be removed in order to provide access.

The present invention employs knee brace assemblies which are the same as or similar to the conventional assemblies, but a pair of knee brace assemblies is employed for each panel brace assembly 18, in a tripod-like arrangement therewith, whereby the prior lateral bracing is eliminated. Each of the knee brace assemblies 20 and 20' employed in the invention includes a knee brace sub-assembly 74, illustrated in FIG. 7, which is a conventional structure. The subassembly 74 includes elongated pipe means 76 connected to clamp means 78 at the upper end 80 of the sub-assembly.

The pipe means 76 includes upper and lower telescoping cylindrical tubular metal pipe sections 82 and 84, respectively. The lower pipe section 84 is provided with a pair of diametrically opposed longitudinal slots 86 extending inwardly from its upper end, and with a pair of diametrically opposed fastener holes 88 adjacent to its lower end. A collar 90 ecompasses the slotted upper end of the lower pipe section 84 and is fixed to one side thereof by spot welds 92. A tightening screw 94 extends through a screw hole 96 in the collar 90 in threaded engagement therewith, and the screw bears on the adjacent side of the lower pipe section. Tightening the screw 94 serves to clamp the upper pipe section 82 between the slotted end portions of the lower pipe section 84. By these means, the longitudinal positions of the upper and lower pipe sections 82 and 84 may be adjusted relative to each other, for adjusting the length of the pipe means 76 and thus of the knee brace sub-assembly 74.

The clamp means 78 includes a pair of clamp bars 98 and 100 having outwardly bent central portions **98*a* and 100*a*, respectively. A clevis 102 is secured to the central portion 100*a* of one clamp bar 100 in a suitable manner, such as by welding. The clevis 102 is connected to the upper pipe section 82 by a headed pin fastener 112 extending through registering openings, not shown, in the clevis and the upper pipe section 82, and a cotter pin 114** extending through a hole in the tail portion of the fastener.

Figure 4:
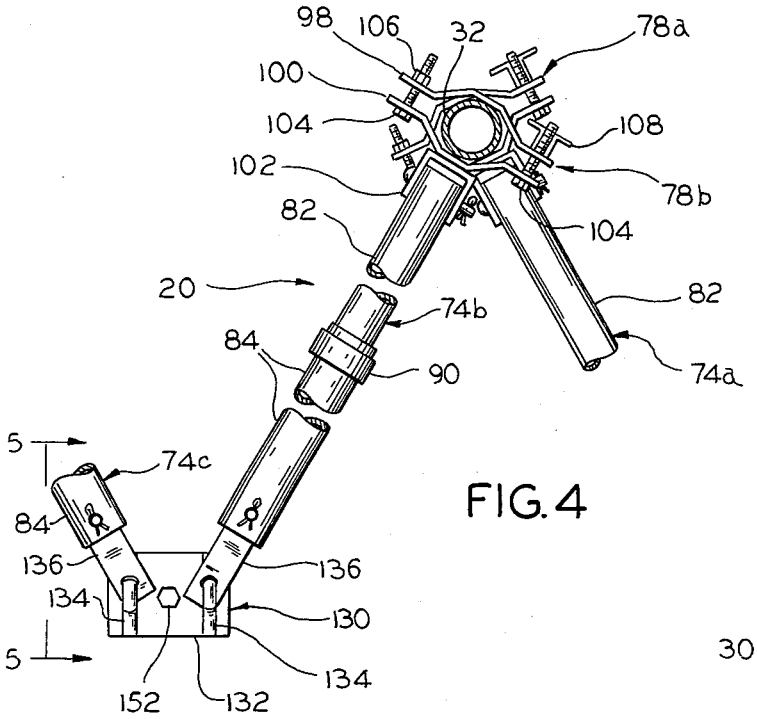
FIG. 4 is a further enlarged fragmentary sectional and elevational view, taken on line 4—4 of FIG. 3.

The clamp bars are connected together at opposite ends thereof by bolts 104 having contour threads, and nuts 106 and 108, respectively. One of the bolts 104 extends through registering holes, not shown, in the adjacent ends of the clamp bars 98 and 100, and the bolt is secured by a hexagonal nut 106. The opposite ends of the bars 98 and 100 are provided with transverse slots 110 which receive a bolt 104, and the nut 108 employed thereat is a wing nut. This construction serves for rapid manual attachment of the knee brace sub-assembly 74 to another pipe section, which is clamped between the clamp bars 98 and 100 upon tightening the wing nut 108, as illustrated in FIGS. 3 and 4.

Figures 7, 8, 9, 10, 11:
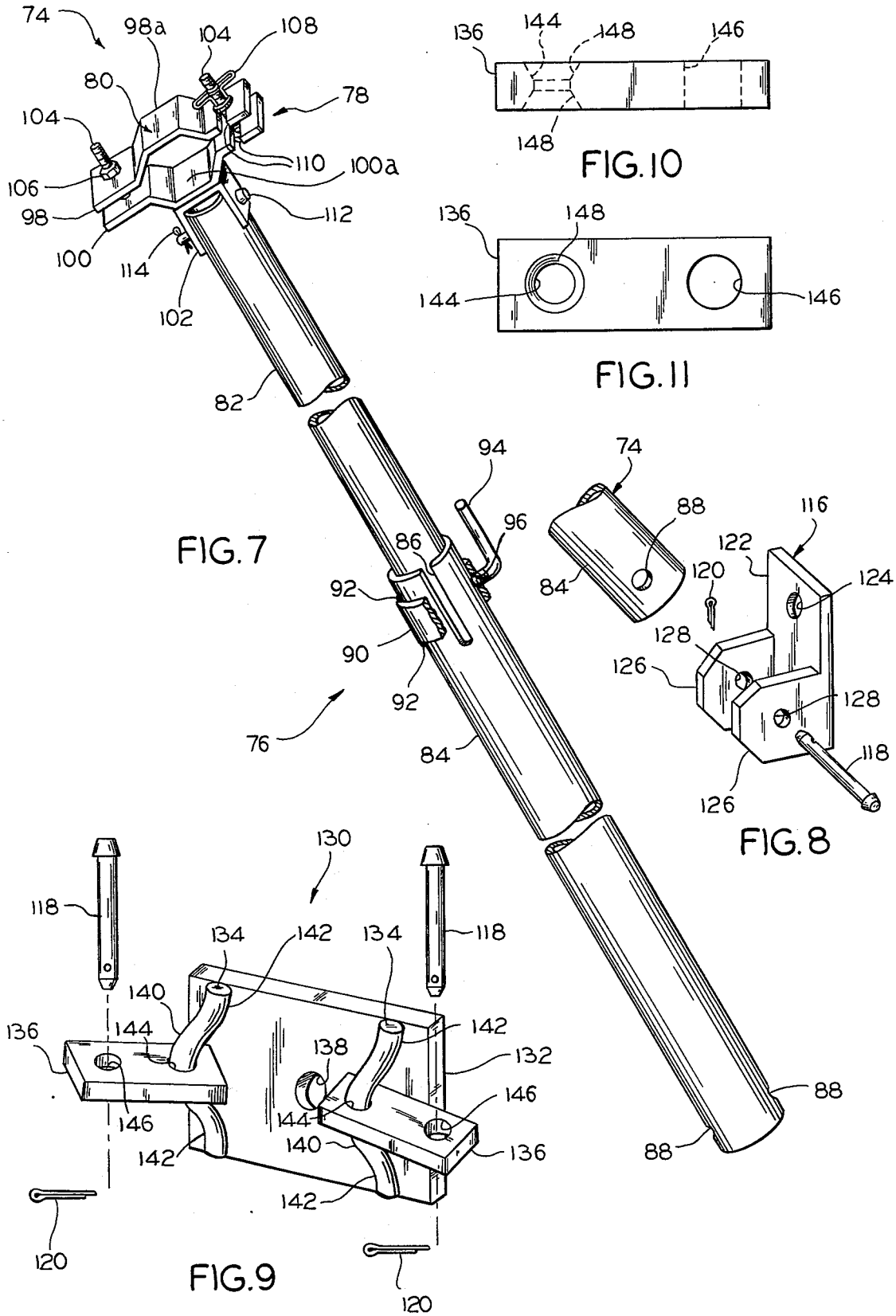
FIG. 7 is a similarly enlarged broken perspective view of a sub-assembly of a knee brace assembly in the bracing apparatus, with a part thereof broken away and in section.
FIG. 8 is an exploded perspective view of a mounting bracket which may be attached to the lower end of the sub-assembly illustrated in FIG. 7, to complete a knee brace assembly.
FIG. 9 is a perspective view of a connector which may be attached to the lower ends of two sub-assemblies having the structure illustrated in FIG. 7, as an alternative to attachment of the bracket of FIG. 8, to complete two knee brace assemblies.
FIGS. 10 and 11 are, respectively, enlarged side elevational and top plan views of a connecting link, two of which are employed in the connector.

FIG. 8 illustrates one form of mounting means which is combined with the knee brace sub-assembly 74 of FIG. 7 to provide one form of knee brace assembly employed in the invention, that is, the assembly 20'. The mounting means includes a metal mounting bracket 116, a headed pin fastener 118, and a cotter pin 120. The mounting bracket 116 includes a rectangular base portion 122 having a fastener hole 124 adjacent one end thereof. The bracket 116 also includes two spaced parallel longitudinally extending wing portions 126 adjacent the other end of the bracket, which are integral with the base portion 122 and upstanding thereon. Registering fastener holes 128 are provided in the respective wing portions 126, and they receive the fastener 118 therethrough. The fastener holes 128 in the wing portions 126 are arranged for registering with the fastener holes 88 at the lower end of the lower pipe section 84, when the latter is inserted between the wing portions, for securing the mounting bracket 116 to the pipe section by insertion of the fastener 118 through the registering holes and inserting the cotter pin 120 through a hole in the tail portion of the fastener. The bracket 116 is connected to a wall panel 14 by inserting a bolt, not shown, through the fastener hole 124 into a suitable hole or insert in the wall panel.

FIGS. 9–11 illustrate a novel second form of mounting means, which is employed with the knee brace sub-assembly 74 of FIG. 7 to provide a second form of knee brace assembly employed in the invention, that is, assembly 20. The mounting means of FIGS. 9–11, however, serves to complete knee brace assemblies with two sub-assemblies 74, which are connected thereto. The second mounting means includes a dual connector 130, two pin fasteners 118 of the type illustrated in FIG. 8, and two cotter pins 120.

The connector 130 includes a rectangular metal base plate 132, and swivel means comprising a pair of spaced parallel swivel links 134 and a pair of connecting links 136. The base plate 132 is provided with a central circular fastener hole 138. Each of the swivel links 134 is constructed of a circular metal rod or heavy wire, and it has a central wavelike bend 140 between opposite, coaxial, generally cylindrical ends 142 thereof. The ends 142 of the swivel links 134 are fixed, as by welding, to one side of the base plate 132 on opposite sides of the fastener hole 138 and spaced outwardly therefrom. The link bends 140 project outwardly from the base plate 132 in planes substantially perpendicular thereto.

As seen most clearly in FIGS. 10 and 11, each of the connecting links 136 is a rectangular metal bar having a mounting hole 144 in one end thereof and a fastener hole 146 in the remaining end thereof. The mounting hole 144 is countersunk to provide conically flaring opposite hole wall end portions 148. The bend 140 of each swivel link 134 extends through the mounting hole 144 of one of the connecting links 136. Each connecting link 136 thereby is mounted for turning movement about longitudinal and transverse axes relative to the base plate 132. Thus, a connecting link 136 may rotate about the axis of its mounting hole 144, as generally illustrated in FIG. 9. The connecting link 136 also may rotate generally about an axis extending in a perpendicular direction, that is, perpendicular to the drawing of FIG. 5, which rotation is facilitated by the provision of the flaring hole wall ends 148.

Figure 5:
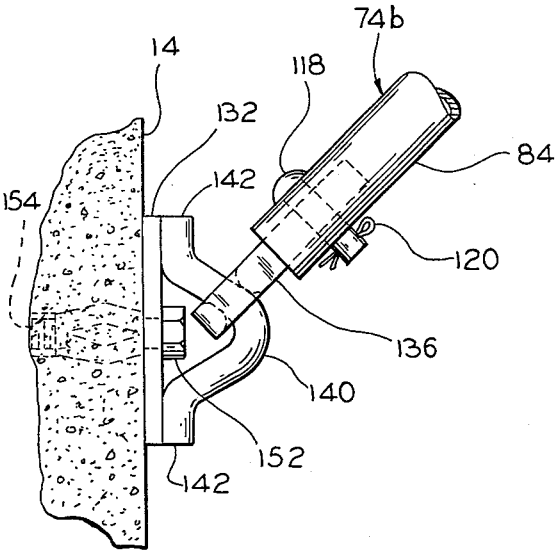
FIG. 5 is a still further enlarged fragmentary side elevational view, taken on line 5—5 of FIG. 4.

The width of each connecting link 136 is slightly smaller than the inside diameter of the lower pipe section 84 of the knee brace sub-assembly 74, so that the end of the connecting link having the fastener hole 146 therein may be inserted into the open lower end of the pipe section 84, as illustrated in FIGS. 4 and 5. The fastener hole 146 in the connecting link 136 is adapted for registering with the aligned fastener holes 88 in the lower pipe section 84, to receive a fastener 118 therethrough. The fastener 118 is secured by a cotter pin 120. Two knee brace sub-assemblies 74 are connected to the connector 130 with the lower pipe section 84 of each sub-assembly connected to one of the connecting links 136 in this manner. Each knee brace sub-assembly 74 when so connected may be swung about longitudinal and transverse axes with respect to the base plate 132, so that the knee brace sub-assembly 74 may extend at various angles with respect to the base plate.

A pair of knee brace sub-assemblies 74 is connected to one panel brace assembly 18, as illustrated most clearly in FIGS. 3 and 4, where successive knee brace sub-assemblies are numbered **74*a*, 74*b* and 74*c*, the first two sub-assemblies having clamp means numbered 78*a* and 78*b*, respectively. The clamp bars 98 and 100 on each of the sub-assemblies 74*a* and 74*b* connected to the one panel brace assembly 18 are arranged on opposite sides of the lower pipe section 32 thereof and secured thereto by suitably tightening the bolts 104 and nuts 106 and 108. The respective clamp means 78*a* and 78*b* of the knee brace sub-assemblies 74*a* and 74*b* preferably are arranged at about the midpoint of the pipe means 22 of the panel brace assembly 18, as measured between the upper and lower mounting brackets 24. The pipe means 22 of the panel brace assembly 18 and the pipe means 76 of the knee brace sub-assemblies 74*a* and 74*b* are substantially perpendicular to each other. However, the locations of the knee brace sub-assemblies 74*a* and 74*b*, and the angle of the pipe means 76 thereof may be varied and yet produce satisfactory results, particularly where the preferred disposition of the knee brace assembly 20 or 20'** provides bracing strength in excess of load requirements.

Each knee brace sub-assembly 74 is connected to a mounting bracket 116, to complete a knee brace assembly 20', or to a connector 130, to complete a knee brace assembly 20, depending upon the location at which the knee brace assembly is to be connected to a panel 14 and the manner in which a wall is erected with a series of panels. FIG. 1 illustrates panels 14 erected with their side edges 73 in abutting relation. In such an application, knee brace assemblies 20 having connectors 130 are employed, except at the ends of the wall, where knee brace assemblies 20' having mounting brackets 116 are employed. FIG. 2 illustrates wall panels 14 having their side edges 73 spaced apart, to allow the formation of pilasters between the panels while they are braced. In such an application, knee brace assemblies 20 having connectors 130 extend towards the centers of the panels 14, and knee brace assemblies 20' having mounting brackets 116 extend toward the side edges 73 of the panels.

FIGS. 4 and 5 illustrate the manner in which the knee brace sub-assembly **74*b* of one pair of sub-assemblies 74*a* and 74*b* is connected to a connector 130, together with the knee brace sub-assembly 74*c* of an adjacent pair of knee brace sub-assemblies, and the connector is in turn connected to a wall panel 14. The lower pipe section 32 of the sub-assembly 74*b* is connected to a connecting link 136 in the manner described above. The connector 130 is connected to the wall panel 14 by means of a bolt 152, which preferably is an expansion bolt, inserted through the fastener hole 138 (FIG. 9) in the base plate 132 and into a bolt hole 154 (FIG. 5) drilled in the concrete panel 14. When installed, the knee brace assembly 74*b*, part of a knee brace assembly 20, extends angularly upwardly from the wall panel 14 to the panel brace assembly 18 to which it is connected. Other knee brace assemblies 20 are installed similarly. It is a distinct advantage that one connector 130 serves to connect two knee brace assemblies 20 to a panel, and requires drilling but one bolt hole 154** to make the connection.

Other knee brace sub-assemblies 74 may be connected to mounting brackets 116 to form knee brace assemblies 20', in the manner illustrated in FIG. 8 and described above. A bolt, not shown, which preferably is an expansion bolt like the connector bolt 152, is inserted through the fastener hole 124 in the base portion 122 of the mounting bracket 116 of a knee brace assembly 20', and into a drilled hole in a panel 14, to connect the knee brace assembly to the wall panel, similarly to the connection of a knee brace assembly 20 to a wall panel. The knee brace sub-assemblies 74 of the knee brace assemblies 20' also extend angularly upwardly from the wall panels 14 to the panel brace assemblies 18 to which their upper ends are connected.

As illustrated in FIGS. 1 and 2, the lower ends of the knee brace assemblies 20 and 20' in each pair of assemblies which is connected to a panel brace assembly 18 are connected to a wall panel 14 at spaced apart points on opposite sides of the vertical plane containing the panel brace assembly, thereby providing a tripod-like bracing structure. A connector 130 preferably is mounted centrally between the side edges 73 of each panel 14, being spaced approximately one-half of the distance between successive panel brace assemblies 18 on a panel. A knee brace sub-assembly 74 from each of such panel brace assemblies 18 is connected to the centrally located connector 130, to complete two knee brace assemblies 20. Where panels abut, as in FIG. 1, a connector 130 is mounted on one of the panels 14, and a knee brace sub-assembly 74 from each of the successive panel brace assemblies 18 on opposite sides of the joint between the panels is connected to the connector 130. It is preferred that the bolt hole 154 provided for the connector bolt 152 in the one panel be spaced from the adjacent side edge of the panel a minimum distance of about 6 inches.

In the pilaster application illustrated in FIG. 2, where the adjacent side edges 73 of adjacent panels 14 may be spaced apart about 1–2 feet, the knee brace assemblies 20' are employed between the successive panel brace assemblies 18 on opposite sides of the pilaster location between panels. The mounting brackets 116 of the knee brace assemblies 20' are connected to the panels 14 at points sufficiently spaced from the panel side edges 73 to allow for the erection of formwork for the pilaster. In order to provide adequate lateral support, it is preferred that the vertical plane in which the knee brace assembly 20' lies be inclined at a minimum angle of about 5° to the vertical plane containing the panel brace assembly 18 to which the knee brace assembly 20' extends. In practice, the workmen are instructed to preserve a horizontal distance *d* of at least 1 foot between the vertical plane of each panel brace assembly 18 and the bracket 116 connected to the knee brace assembly 20' supporting the same. While the preferred minimum angle applies to all of the knee brace assemblies 20 and 20', it is preferred that the aforesaid angle of inclination be greater where sufficient room exists. The closest approach of a knee brace assembly to the plane of a panel brace assembly braced thereby occurs adjacent to a pilaster.

It will be noted from FIG. 1 and the above description thereof that certain ones of the knee brace assemblies 20 are connected to the wall panels 14 to which their associated panel brace assemblies 18 are connected, and certain other knee brace assemblies 20 are connected to wall panels 14 which are adjacent to the wall panels to which their associated panel brace assemblies 18 are connected. It is to be understood that reference made in a claim hereof to a tilt-up wall panel to which a panel brace assembly is connected and to connection of a knee brace assembly to such panel is intended to be inclusive of connection of the respective assemblies to adjacent wall panels.

The pipe brace assemblies 18 in preferred embodiments of the invention are about 16 to 39 feet in length, and the knee brace assemblies 20 and 20' may extend from 9½ feet to 17 feet. In use, the upper ends 26 of the panel brace assemblies 18 are connected to the anchor inserts 72 before raising the panels 14, as described above. After the panels 14 are raised and while still supported from a crane, the lower ends 28 of the panel brace assemblies 18 are connected to the anchor inserts 68 in the floor slab 16. The length of the pipe means 22 is adjusted to render the panels 14 plumb. Coarse adjustments are made by appropriate adjustment in the relative positions of the telescopic pipe sections 30 and 32. Fine adjustments are made by turning the pipe sections 30 and 32 relative to the rotation fitting 46, so that the extension screw 35 moves longitudinally inwardly or outwardly relative to the pipe sections.

The knee brace assemblies 20 and 20' are clamped to the pipe sections 32 of the panel brace assemblies 18 by the clamp means 78. The mounting brackets 116 of the knee brace assemblies 20' and the connectors 130 of the knee brace assemblies 20 are connected to the panels 14, by inserting bolts 152 through their respective fastener holes 116 and 138, into bolt holes in the panels, such as the hole 154 shown in FIG. 5. The bolt holes may be drilled in the panels prior to or following the raising of the panels into their vertical positions. The length of a knee brace assembly 20 or 20' may be adjusted as necessary, by loosening the tightening screw 94, moving the upper and lower pipe sections 82 and 84 telescopically with respect to each other, and then tightening the screw 94.

With the apparatus connected for bracing the tilt-up wall panels 14 as illustrated in FIGS. 1 and 2, mobile equipment may be moved up close to the panels at the locations of the mounting brackets 116 and the connectors 130. No bracing members need be disconnected for that purpose, so that there is no time spent in disconnecting and connecting such members. The panels 14 are securely braced at all times, with bending or sway of the panel brace assemblies prevented. In the arrangement of FIG. 2, access is provided to the side edges 73 and adjacent areas of the panels, for erection of pilaster forms, placing the concrete, and stripping the forms, while the bracing remains intact.

While certain preferred embodiments of the invention have been illustrated and described, it will be apparent to those skilled in the art that various changes and modifications may be made therein within the spirit and scope of the invention. It is intended that such changes and modifications be included within the scope of the appended claims.

Having thus described the invention, what I claim as new and desire to secure by Letters Patent is:

1. In combination with a tilt-up wall panel in raised position adjacent to a floor slab and a panel brace assembly extending angularly upwardly from said slab to said panel and having its lower end connected to the slab and its upper end connected to the panel to brace the panel, a pair of knee brace assemblies each extending angularly upwardly from said panel to said panel brace assembly, said knee brace assemblies having their upper ends connected to the panel brace assembly and their lower ends connected to the panel at spaced apart points on opposite sides of the vertical plane containing the panel brace assembly to brace the assembly.

2. A combination as defined in claim 1 and wherein said vertical plane containing the panel brace assembly is substantially perpendicular to said panel, and each of said knee brace assemblies lies in a vertical plane at a minimum angle of about 5° to the former plane.

3. A combination as defined in claim 1 and wherein said panel brace assembly includes elongated pipe means connected to mounting means at opposite ends of the assembly, said mounting means in turn being connected to said slab and said panel respectively, and said knee brace assemblies each include elongated pipe means connected to clamp means at one end of the assembly and mounting means at the opposite end of the assembly, said clamp means of each knee brace assembly clamping the assembly to the pipe means of said panel brace assembly, said mounting means of each knee brace assembly in turn being connected to said panel.

4. A combination as defined in claim 3 and wherein said vertical plane containing the panel brace assembly is substantially perpendicular to said panel, and each of said knee brace assemblies lies in a vertical plane at a minimum angle of about 5° to the former plane.

5. In combination with a tilt-up wall panel in raised position adjacent to a floor slab and a pair of spaced apart panel brace assemblies extending angularly upwardly from said slab to said panel and having their lower ends connected to the slab and their upper ends connected to the panel to brace the panel, a pair of knee brace assemblies for each of said panel brace assemblies, the knee brace assemblies in each pair extending angularly upwardly from said panel, having their upper ends connected to one of said panel brace assemblies, and having their lower ends connected to said panel at spaced apart points on opposite sides of the vertical plane containing said one panel brace assembly to brace the assembly, whereby two of said knee brace assemblies extend laterally between said panel brace assemblies, said two knee brace assemblies including a connector common to both and comprising the lower end of each assembly, and said connector being connected to said panel intermediate the vertical planes containing said panel brace assemblies.

6. A combination as defined in claim 5 and wherein said vertical planes containing the panel brace assemblies are substantially perpendicular to said panel, and each of said knee brace assemblies lies in a vertical plane at a minimum angle of about 5° to the vertical plane containing the panel brace assembly to which it extends.

7. A combination as defined in claim 5 and wherein each of said panel brace assemblies includes elongated pipe means connected to mounting means at opposite ends of the assembly, said mounting means in turn being connected to said slab and said panel, respectively, and said knee brace assemblies each include elongated pipe means connected to clamp means at one end of the assembly and mounting means at the opposite end of the assembly, said clamp means of each knee brace assembly clamping the assembly to the pipe means of the panel brace assembly to which the knee brace assembly is connected with the pipe means of the respective panel and knee brace assemblies extending substantially perpendicular to each other, said mounting means of said two knee brace assemblies comprising said connector and said mounting means of the remaining two knee brace assemblies also being connected to said panel.

8. A combination as defined in claim 7 and wherein said vertical planes containing the panel brace assemblies are substantially perpendicular to said panel, and each of said knee brace assemblies lies in a vertical plane at a minimum angle of about 5° to the vertical plane containing the panel brace assembly to which it extends.

9. A combination as defined in claim 8 and wherein said connector is connected to said panel about midway between said vertical planes containing the panel brace assemblies.

10. In combination with a pair of panel brace assemblies adapted for bracing a tilt-up wall panel is raised position adjacent to a floor slab with the assemblies extending angularly upwardly from said slab to said panel in spaced apart relation and with their lower ends connected to the slab and their upper ends connected to the panel, a pair of knee brace assemblies for each of said panel brace assemblies, the knee brace assemblies in each pair being adapted for extending angularly upwardly from said panel, for having their upper ends connected to one of said panel brace assemblies in its bracing position, and for having their lower ends connected to said panel at spaced apart points on opposite sides of the vertical plane containing said one panel brace assembly in its bracing position to brace the assembly, one of said knee brace assemblies in each pair including a connector at its lower end which is common to the two assemblies, and said connector being adapted to be connected to said panel intermediate the vertical planes containing said panel brace assemblies in their bracing positions.

11. A combination as defined in claim 10 and wherein said connector comprises a base plate adapted to be connected to said panel, and a pair of swivel means mounted on one side of said base plate and each forming part of one of said two knee brace assemblies.

12. A combination as defined in claim 10 and wherein each of said panel brace assemblies includes elongated pipe means connected to mounting means at opposite ends of the assembly, said mounting means being adapted to be connected to said slab and said panel respectively, and said knee brace assemblies each include elongated pipe means having an upper end connected to clamp means at the upper end of the assembly and a lower end connected to mounting means at the lower end of the assembly, said clamp means of each knee brace assembly being adapted for clamping the assembly to the pipe means of the panel brace assembly to which the knee brace assembly is connected, said mounting means of said two knee brace assemblies comprising said connector and said mounting means of the remaining two knee brace assemblies also being adapted to be connected to said panel.

13. A combination as defined in claim 12 and wherein said connector comprises a base plate adapted to be connected to said panel, and a pair of swivel means mounted on one side of said base plate, each swivel means being connected to the lower end of the pipe means of one of said two knee brace assemblies.

14. A connector for dual connection of knee brace assemblies to a wall panel and comprising:

a base plate having a fastener hole therein adapted for receiving a fastener to connect the base plate to a wall panel, a pair of swivel links fixed to one side of said base plate on opposite sides of said fastener hole, and a pair of connecting links each having a mounting hole therein through which one of said swivel links extends to mount the connecting link for turning movement about longitudinal and transverse axes relative to said base plate, each of said connecting links also having means adapted for connecting the link in a knee brace assembly with the connector forming a component thereof.

15. A connector as defined in claim 14 and wherein said swivel links each comprise a circular rod having a wavelike bend therein extending through said mounting hole of a connecting link, and said connecting links each comprise a rectangular bar one end of which is provided with said mounting hole and the remaining end of which is insertable into the open end of a pipe component of a knee brace assembly and is provided with a fastener hole adapted for registering with fastener holes in such component to receive a fastener therethrough.

* * * * *